US007111345B1

(12) United States Patent
Hui

(10) Patent No.: US 7,111,345 B1
(45) Date of Patent: Sep. 26, 2006

(54) QUILT

(75) Inventor: Cheung Wing Hui, Tsuen Wan (HK)

(73) Assignee: Hotung Investments Ltd., Tortola (VG)

( * ) Notice: Subject to any disclaimer, the term of this patent is extended or adjusted under 35 U.S.C. 154(b) by 0 days.

(21) Appl. No.: 11/333,272

(22) Filed: Jan. 18, 2006

(51) Int. Cl.
*A47G 9/04* (2006.01)
*A47G 9/00* (2006.01)

(52) U.S. Cl. ..... 5/501

(58) Field of Classification Search ..... 5/501, 5/502, 500, 482
See application file for complete search history.

(56) References Cited

U.S. PATENT DOCUMENTS 1,347,642 A * 7/1920 McNatt ..... 5/502
2,183,360 A * 12/1939 Sussman ..... 5/501
2,505,027 A * 4/1950 Belsky ..... 5/501
3,008,152 A * 11/1961 Seidenberg ..... 5/501

* cited by examiner

*Primary Examiner*—Alexander Grosz
(74) *Attorney, Agent, or Firm*—Leydig, Voit & Mayer, Ltd.

(57) ABSTRACT

A quilt has a quilt cover and a quilt body for use therein. The quilt cover has top and bottom panels, several peripheral openings between the top and bottom panels, and a pair of co-operable top and bottom snap fasteners at each opening on the top and bottom panels, respectively. The quilt body has peripheral parts adjacent the openings when the quilt body is used inside the quilt cover. Each peripheral part is engageable by the respective pair of snap fasteners to hold the quilt body in position relative to the quilt cover. Each peripheral part has a hole through the quilt body through which the respective snap fasteners fasten together, thereby holding the peripheral part.

4 Claims, 4 Drawing Sheets

QUILT

The present invention relates to a quilt or duvet for sleeping.

SUMMARY OF THE INVENTION

According to the invention, there is provided a quilt comprising a quilt cover and a quilt body for use therein. The quilt cover has top and bottom panels, a plurality of peripheral openings formed between the top and bottom panels, and a pair of co-operable top and bottom fasteners provided at each opening on the top and bottom panels respectively. The quilt body includes peripheral parts adjacent the openings when the quilt body is used inside the quilt cover, each peripheral part being engageable by the respective pair of top and bottom fasteners to hold the quilt body in position relative to the quilt cover. Each peripheral part has a hole through the quilt body through which the respective top and bottom fasteners are to fasten together, thereby engaging the peripheral part.

Preferably, each hole has a rim which is reinforced by stitches sewed around it.

More preferably, the rim of each hole is reinforced by overlock stitching.

It is preferred that the top and bottom fasteners of each pair comprise co-operable snap fasteners.

It is preferred that the top and bottom fasteners of each pair are provided on in-turned edge portions of the top and bottom panels respectively.

In a preferred embodiment, the quilt cover has a substantially rectangular shape having two longer sides and two shorter sides, and includes one said peripheral opening and associated pair of fasteners adjacent each corner.

More preferably, the quilt cover includes three said peripheral openings and associated pairs of fasteners at mid-length of each of the two longer sides and one shorter side, with the other shorter side being openable for insertion of the quilt body into the quilt cover.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 7:
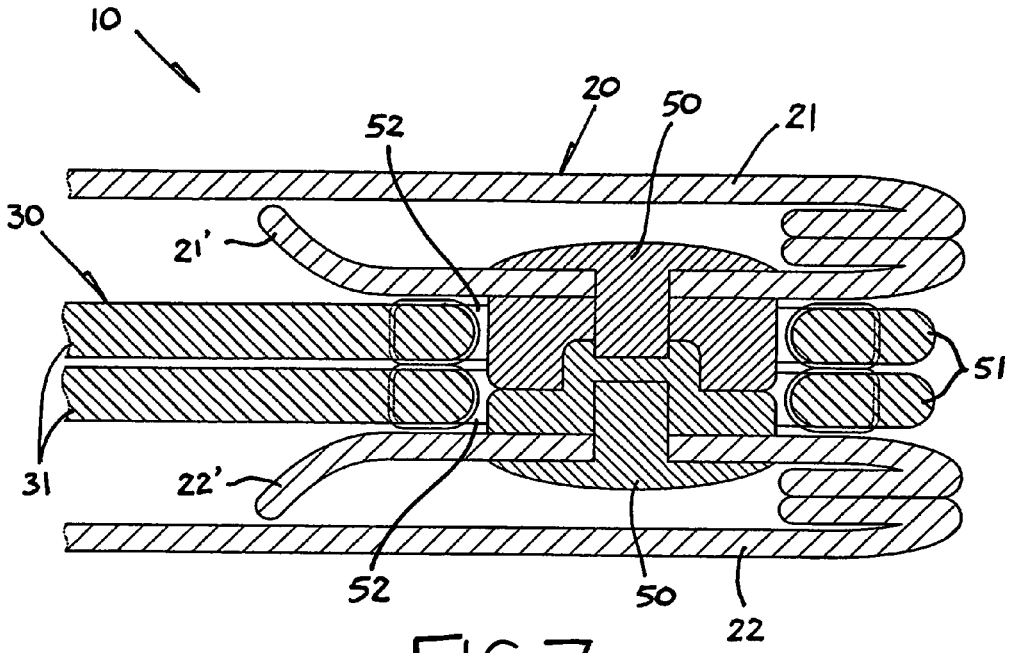
FIG. 7 is a cross-sectional side view of the quilt corner of FIG. 6.

Referring to the drawings, there is shown a quilt 10 embodying the invention, which quilt 10 comprises a quilt cover 20 and a quilt body 30 used inside the cover 20. The quilt cover 20 has a hollow flat body that is formed by a top panel 21 and a bottom panel 22 stitched together along respective in-turned edge portion or stitched-on hems 21' and 22' (FIG. 7). The top panel 21 is cross-stitched with an internal layer of artificial wool, down or feather such that the cover 20 itself may be used alone as a quilt for warmth keeping in a not-too-cold weather.

The quilt body 30 consists of two sheets or blankets 31 made of artificial wool or the like. One or both of the blankets 31 may be used inside the quilt cover 20 as desired (FIGS. 8 and 7) for additional warmth keeping.

The quilt cover 20 is generally rectangular having two opposite longer sides and two opposite shorter sides, and includes an open shorter side 23 for insertion of the quilt body 30, which is provided with co-operable plastic (or metal) snap fasteners (press studs) 50 at regular positions for closing and in particular holding the quilt body 30 inside.

Seven peripheral openings 24 are formed at or adjacent the four corners and at mid-length of each of the other three sides of the quilt cover 20. The openings 24 are formed by not stitching together along the hems 21' and 22' of the two quilt panels 21 and 22 over a relatively short length.

The co-operable snap fasteners 50 are fixed on respective opposite hems 21' and 22' of each opening 24 for fastening together to, inter alia, close or restrict the opening 24.

Figure 4:
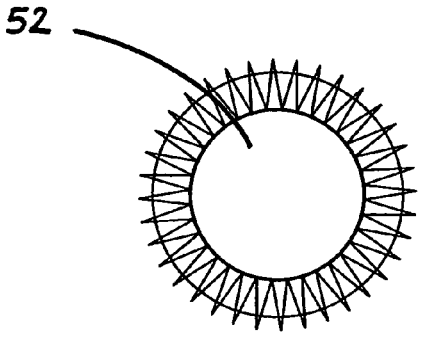
FIG. 4 is a schematic diagram show a hole through the quilt body of FIG. 3, reinforced by overlock stitching.

Each blanket 31 of the quilt body 30 has a generally rectangular shape and includes seven peripheral parts 51 at or adjacent the four corners and at mid-length of each of the two longer and one shorter sides. Each peripheral part 51 is punched with a hole 52 having a rim which is sewed with stitches around it and, more specifically, by overlock stitching or wrap stitching (FIG. 4) for reinforcement or protection of the rim.

Figure 1:
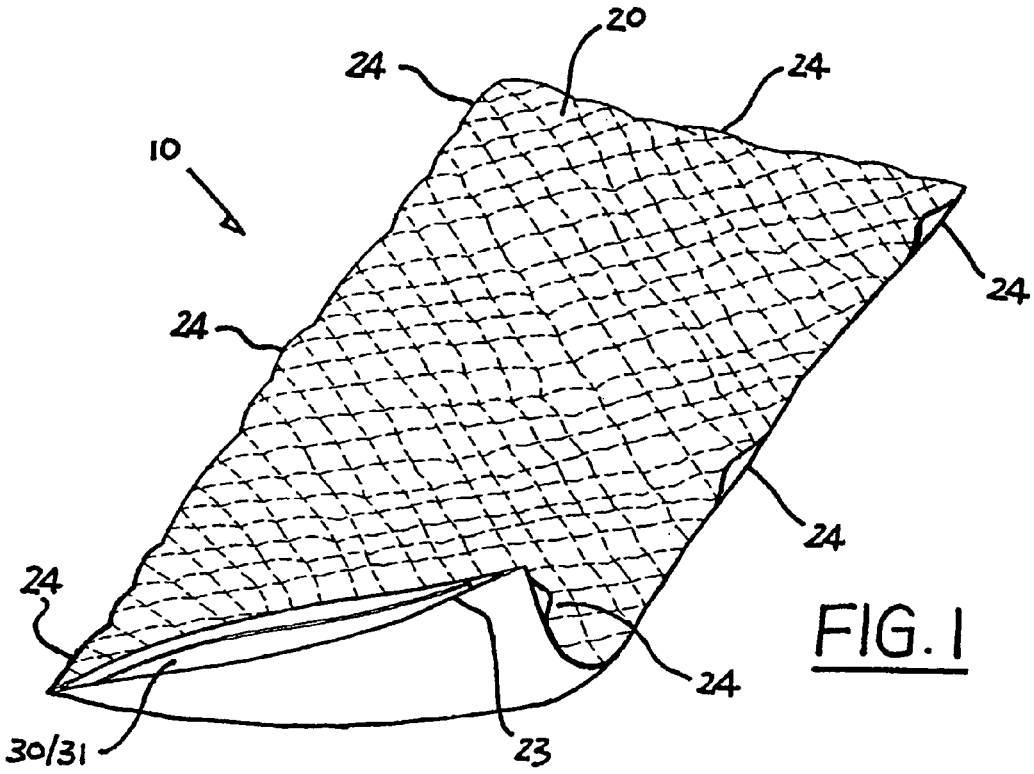
FIG. 1 is a top perspective view of an embodiment of a quilt in accordance with the invention.
Figure 2:
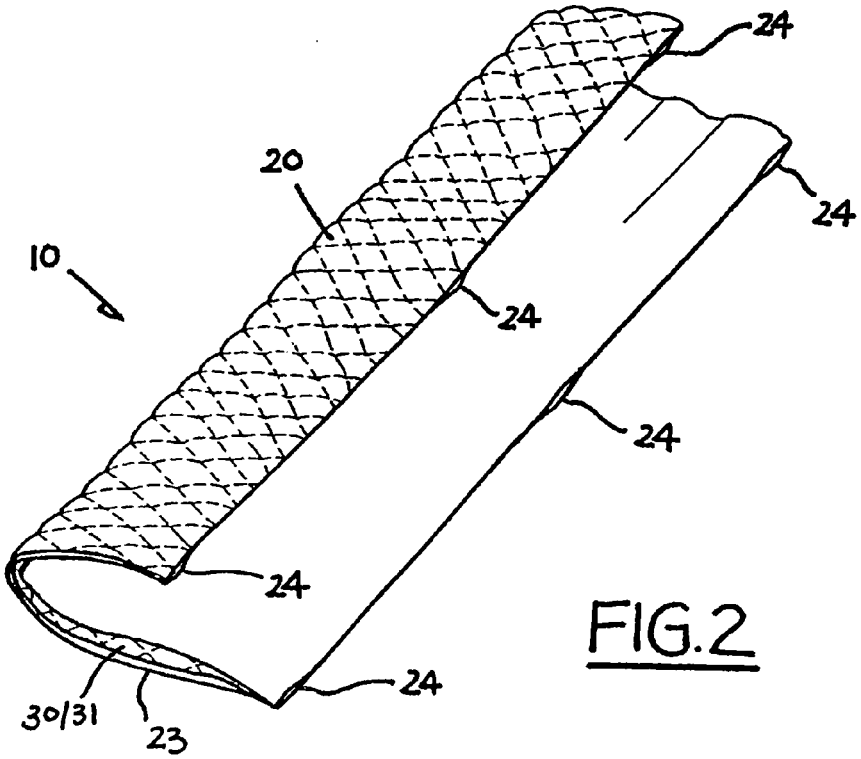
FIG. 2 is a bottom perspective view of the quilt of FIG. 1, folded along its length.
Figure 3:
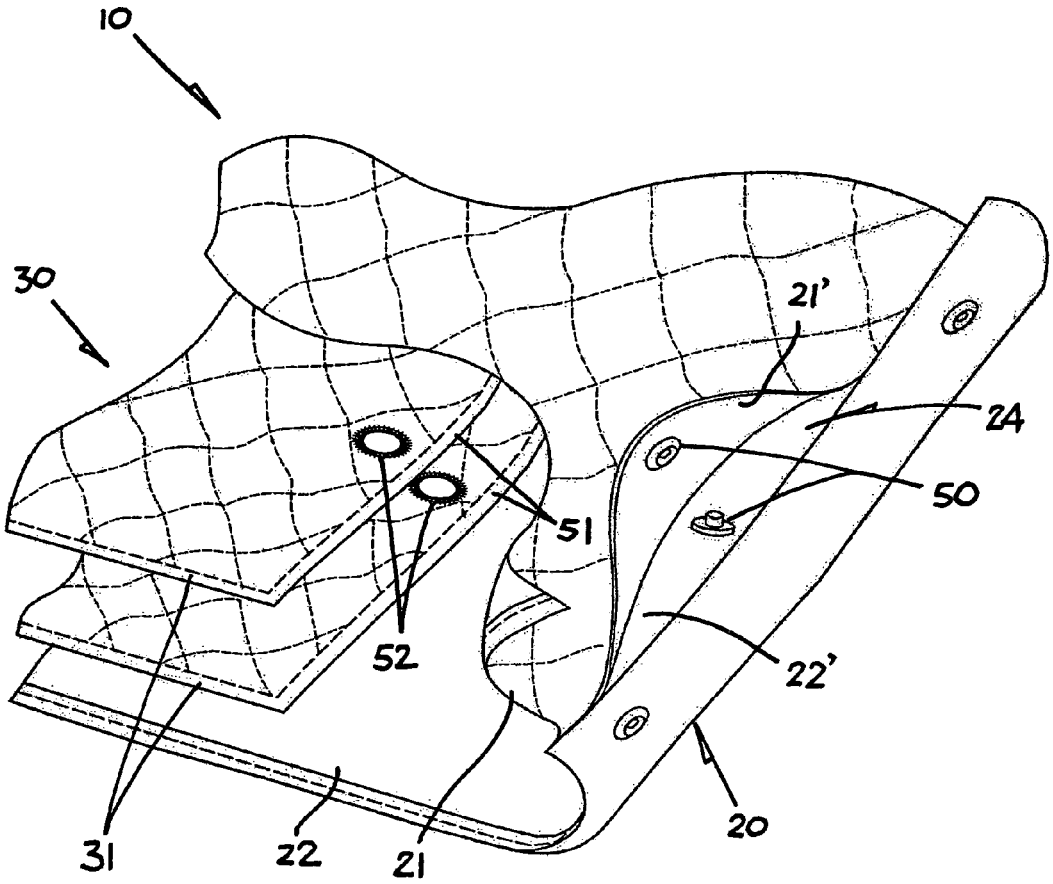
FIG. 3 is a top perspective view of one corner of the quilt of FIG. 1, showing its structure having a quilt cover and a double-sheet quilt body therein.
Figure 5:
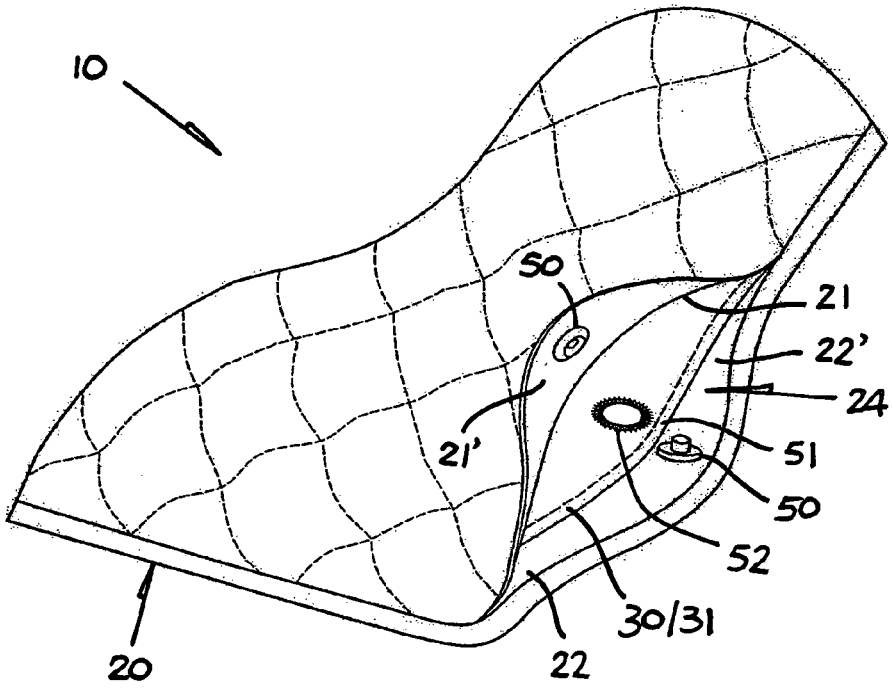
FIG. 5 is a top perspective view corresponding to FIG. 3, illustrating how the quilt body is to be fixed inside the quilt cover.
Figure 6:
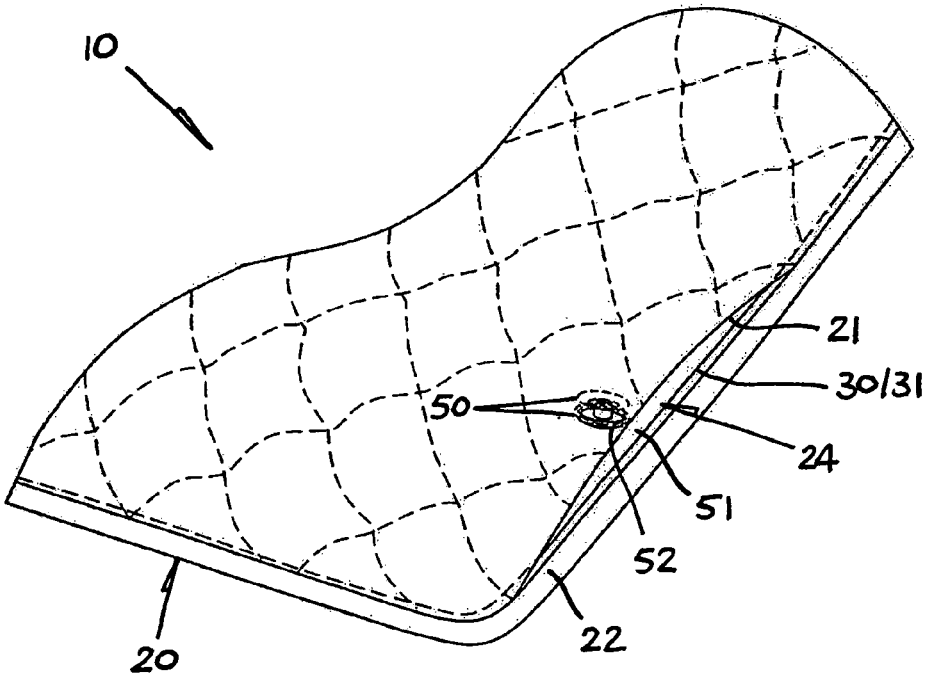
FIG. 6 is a top perspective view corresponding to FIG. 4, illustrating the quilt body (not seen) fixed inside the quilt cover.
Figure 8:
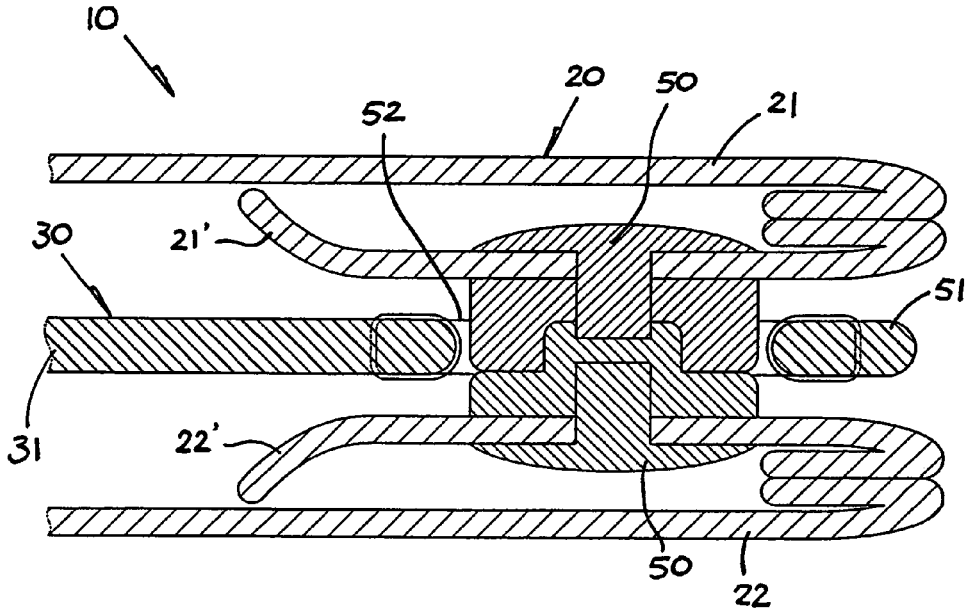
FIG. 8 is a cross-sectional side view of the quilt corner similar to FIG. 7, showing a single-sheet quilt body fixed inside the quilt cover.

In use, the blankets 31 are inserted into the quilt cover 20 (FIG. 3) through its open shorter side 23 and then spread and positioned such that their peripheral parts 51 are aligned with the respective openings 24 of the quilt cover 20 (FIG. 5). While the peripheral parts 51 are being held at or close to the corresponding openings 24, each opening 24 is closed or restricted by the associated snap fasteners 50 engaging or snapping together through the holes 52 of the aligned parts 51 (FIG. 7 or 8). The overall quilt body 30 is thus fixed and maintained by the snap fasteners 50 in position within and relative to the quilt cover 20.

As the snap fasteners 50 are secured on the in-turned hems 21' and 22' of the quilt cover panels 21 and 22, they are concealed from sight in between the edges of the panels 21 and 22.

The invention has been given by way of example only, and various modifications of and/or alterations to the described embodiment may be made by persons skilled in the art without departing from the scope of the invention as specified in the appended claims.

The invention claimed is:

1. A quilt comprising:

a quilt cover having a substantially rectangular shape with two longer sides, two shorter sides, and four corners, top and bottom panels, a plurality of peripheral openings located between the top and bottom panels, and a pair of co-operable top and bottom fasteners located at each opening on the top and bottom panels, respectively, wherein the top and bottom fasteners of each pair of fasteners are located on in-turned edge portions of the top and bottom panels, respectively, and one of the peripheral openings and an associated pair of fasteners are located adjacent each corner; and a quilt body including peripheral parts adjacent the openings when the quilt body is located inside the quilt cover, each peripheral part being engageable by the respective pair of top and bottom fasteners to hold the quilt body in position relative to the quilt cover, wherein each peripheral part has a hole through the quilt body through which the respective top and bottom fasteners fasten together, thereby engaging the peripheral part, and the quilt cover includes three of the peripheral openings and three associated pairs of fasteners at mid-length of each of the two longer sides and one of the shorter sides, with the other shorter side being openable for insertion of the quilt body into the quilt cover.

2. The quilt as claimed in claim 1, wherein each hole has a rim which is reinforced by stitches sewed around the rim.

3. The quilt as claimed in claim 2, wherein the rim of each hole is reinforced by overlock stitching.

4. The quilt as claimed in claim 1, wherein the top and bottom fasteners of each pair of fasteners comprise co-operable snap fasteners.

* * * * *